US009533818B2

(12) United States Patent
Wang

(10) Patent No.: US 9,533,818 B2
(45) Date of Patent: Jan. 3, 2017

(54) CLAMPING DEVICE FOR A SPRAYER CAN

(71) Applicant: APEX MFG. CO., LTD., Taichung (TW)

(72) Inventor: Rong-Yu Wang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 48 days.

(21) Appl. No.: 14/504,715

(22) Filed: Oct. 2, 2014

(65) Prior Publication Data

US 2016/0096677 A1 Apr. 7, 2016

(51) Int. Cl.
*B65D 83/20* (2006.01)

(52) U.S. Cl.
CPC ..... *B65D 83/202* (2013.01)

(58) Field of Classification Search
CPC ... B65D 83/202; B65D 83/752; B65D 83/206; B05B 7/2481
USPC ..... 222/402.1, 474, 402.15; 215/337, 293, 215/272; 220/915
See application file for complete search history.

(56) References Cited

U.S. PATENT DOCUMENTS 5,292,017 A * 3/1994 Reifers ..... B65D 50/061 215/206
5,328,937 A * 7/1994 Cascino ..... B65D 81/107 521/145
2008/0054025 A1* 3/2008 Tsai ..... B65D 83/202 222/402.15
2010/0051652 A1* 3/2010 Becker ..... B65D 83/202 222/402.13
2012/0292337 A1* 11/2012 Becker ..... B65D 83/202 222/1

* cited by examiner

*Primary Examiner* — Kevin P Shaver
*Assistant Examiner* — Robert Nichols, II
(74) *Attorney, Agent, or Firm* — Muncy, Geissler, Olds & Lowe, P.C.

(57) ABSTRACT

A clamping device for a sprayer can is provided, including a shell body. The shell body includes a grip portion and a clamping portion for clamping one end of a sprayer can. The sprayer can is provided with a dispenser valve. The clamping portion includes a circumferential wall, and the circumferential wall defines a space for receiving the dispenser valve and a receiving opening communicating with the space. The circumferential wall is further formed with a window which communicates with the space, and the dispenser valve can spray through the window. The circumferential wall includes first flexible portions and at least one second flexible portion. At least one said second flexible portion is connected between every two adjacent first flexible portions. The second flexible portion is greater than the first flexible portion in flexibility.

8 Claims, 6 Drawing Sheets

CLAMPING DEVICE FOR A SPRAYER CAN

BACKGROUND OF THE INVENTION

Field of the Invention

The present invention relates to a clamping device, and more particularly to a clamping device for a sprayer can.

Description of the Prior Art

A sprayer can is composed of a valve, a container and content, and the content is contained in the container to become a pressure container. When the valve is actuated, the content is released through a corresponding controlling method to outside with a predetermined pressure. It is widely used in sanitary articles, cosmetics, cleansing articles and industrial articles.

However, the sprayer can has inconvenience. For example, a button-typed sprayer can is usually leaking near a button after a period of time in using. The content of the sprayer can is a chemical synthetic and harmful to human health so that it is necessary to avoid from contacting with the content directly. But when a user pushes the button and the content is leaking near the button, the user contacts with the content. This is a big risk to a health of the user.

The present invention has arisen to mitigate and/or obviate the afore-described disadvantages.

SUMMARY OF THE INVENTION

The primary object of the present invention is to provide a clamping device for a sprayer can, for preventing from contacting with a sprayer can directly and reducing a risk of harming human health. A clamping portion of the clamping device can fix a circumferential flange of a sprayer can steadily, and a circumferential wall of the clamping portion is designed to easily and conveniently assemble substantially and to have a strong structural strength.

To achieve the above object, a clamping device for a sprayer can in accordance with present invention includes a shell body. The shell body includes a grip portion and a clamping portion for clamping one end of a sprayer can. The sprayer can is provided with a dispenser valve at the end. The clamping portion includes a circumferential wall, and the circumferential wall defines a space for receiving the dispenser valve and a receiving opening communicating with the space. The circumferential wall is further formed with a window which communicates with the space, and the dispenser valve can spray through the window. The circumferential wall includes a plurality of first flexible portions and at least one second flexible portion transverse to the receiving opening and extending to the receiving opening. The at least one second flexible portion is connected between every two adjacent first flexible portions. The second flexible portion is greater than the first flexible portion in flexibility.

DETAILED DESCRIPTION OF THE PREFERRED EMBODIMENTS

Figure 1:
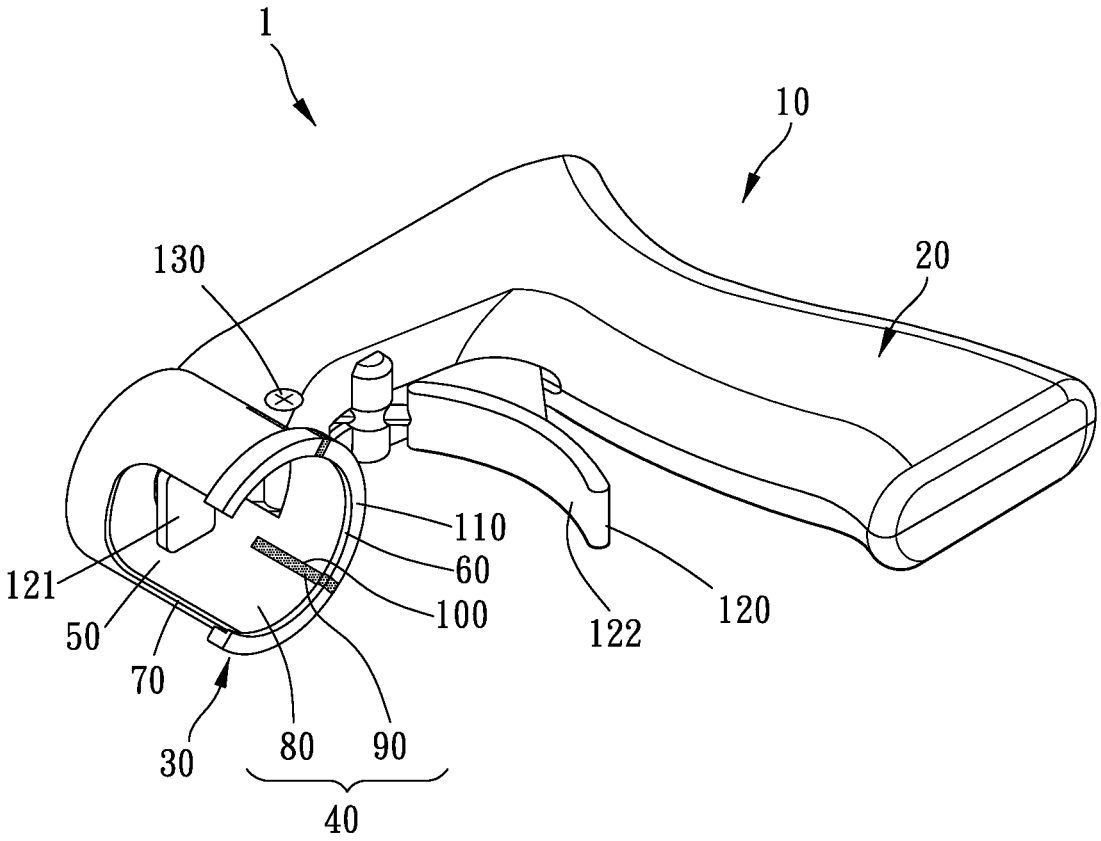
FIG. 1 is a perspective drawing of a clamping device in accordance with a preferable embodiment of the present invention.
Figure 2:
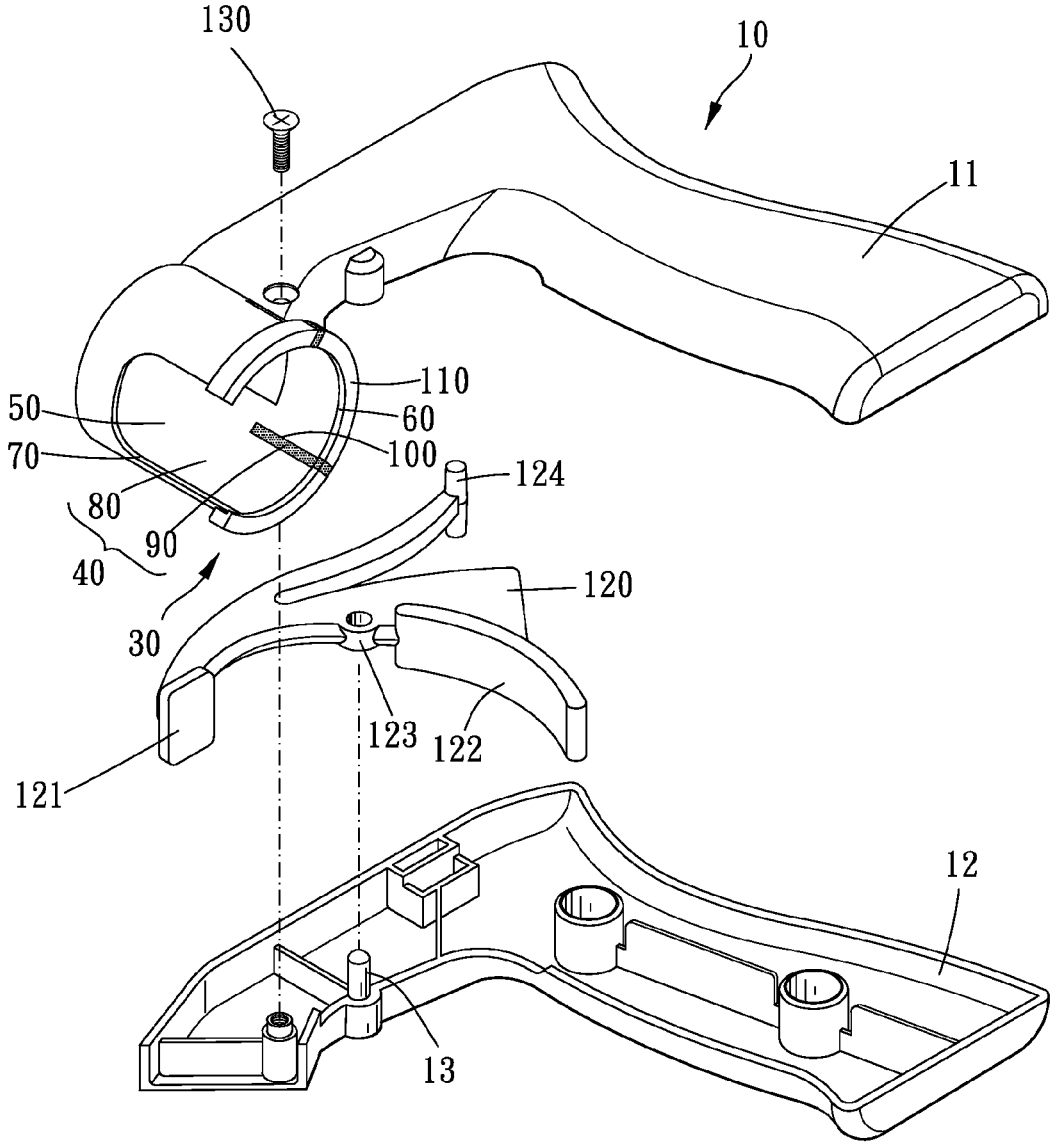
FIG. 2 is a breakdown drawing of the clamping device in accordance with the preferable embodiment of the present invention.
Figure 3:
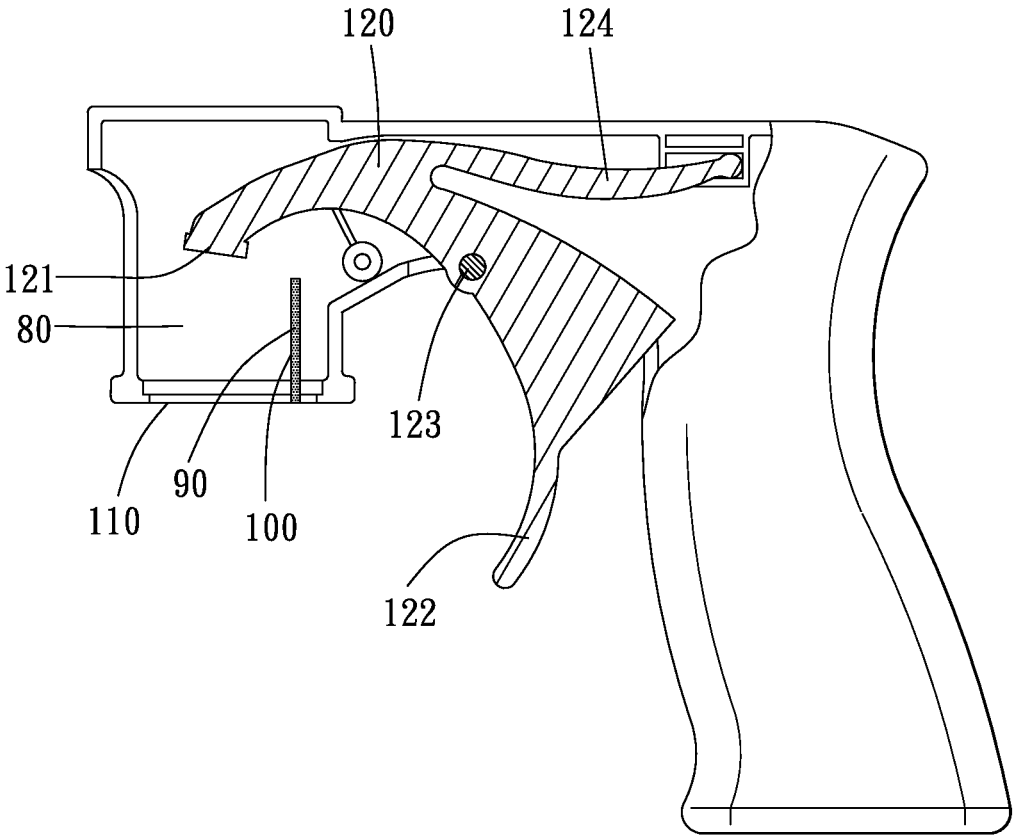
FIG. 3 is a partial cross-sectional drawing of the clamping device in accordance with the preferable embodiment of the present invention.
Figure 4:
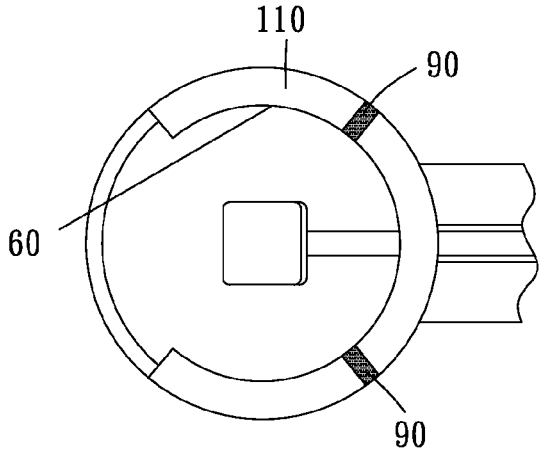
FIG. 4 is a partial perspective drawing of the clamping device in accordance with the preferable embodiment of the present invention.

The present invention will be clearer from the following description when viewed together with the accompanying drawings, which show, for purpose of illustrations only, the preferred embodiment in accordance with the present invention.

Please refer to FIGS. 1-4 and FIGS. 7-8, a clamping device 1 for a sprayer can is provided, including a shell body 10, and the shell body 10 is made of a material such as plastic. Preferably, the shell body 10 made of plastic material is light and strong, and it is durable to use. The shell body 10 further includes two shell members 11, 12, and the two shell members 11, 12 are correspondingly connected to each other and fixed to each other with at least one screw 130. Preferably, through producing and assembling the two shell members 11, 12, the shell body 10 is easy to produce and parts in the shell body 10 are also easy to be assembled. It is noted that, the two shell members 11, 12 can be respectively disposed with a concave portion and a protruding portion to help to locate the two shell members 11, 12 in assembling, and it is convenient for assembling. The shell body 10 is disposed with a grip portion 20, and the grip portion 20 can be designed to have an ergonomic shape for a user to hold with a single hand easily. And the shell body 10 further includes a clamping portion 30 for clamping one end of a sprayer can 140. The sprayer can 140 is provided with a dispenser valve 141 at the end. The dispenser valve 141 has an actuating device which is pushed to eject (via pushing downwardly along an axial direction of the sprayer can 140). When the dispenser valve 141 is pushed by a force, it sprays. The clamping portion 30 includes a circumferential wall 40. The circumferential wall 40 defines a space 50 for receiving the dispenser valve 141 and a receiving opening 60 communicating with the space 50. The receiving opening 60 has an inner diameter smaller than an outer diameter of the end of the sprayer can 140 so that the clamping portion 30 can get stuck with the sprayer can 140. The circumferential wall 40 is further formed with a window 70 communicating with the space 50 and for the dispenser valve 141 to spray to outside.

The circumferential wall 40 defines a plurality of first flexible portions 80 and at least one second flexible portion 90 transverse to a direction of the receiving opening 60 and extending to the receiving opening 60. Every two adjacent first flexible portions 80 are connected with one said second flexible portion 90 disposed therebetween. The second flexible portion 90 is greater than the first flexible portion 80 in flexibility. For example, the first flexible portion 80 and the shell body 10 can have a same material and be formed integrally to have a strong structure. The second flexible portion 90 disposed between the first flexible portions 80 is such as rubber. Compared with the first flexible portion 80, the second flexible portion 90 has larger flexibility and better restitution capability. Conveniently, the circumferential wall 40 is designed so that the clamping portion 30 and the sprayer can 140 are easy to assemble. Preferably, the first flexible portion 80 provides a clamping force for clamping the sprayer can 140. The second flexible portion 90 provides a restitution force for a plurality of said first flexible portions 80 and increases a structural strength of the clamping portion 30. The clamping portion 30 is hard to deform and damage when it assembles to the sprayer can 140. The design of the circumferential wall 40 is substantially easy and convenient for assembling and has a good structural strength.

Furthermore, the circumferential wall 40 includes a main body formed with the first flexible portions 80. Every two adjacent first flexible portions 80 form a slot 100 therebetween and the slot 100 is transverse to and communicated with the receiving opening 60. The second flexible portion 90 each is disposed in one said slot 100 and connected to the adjacent first flexible portions 80. In the present embodiment, the circumferential wall 40 includes a plurality of said second flexible portions 90. For example, the circumferential wall 40 can be formed through plastic injection molding, and the circumferential wall 40 is formed with a plurality of said first flexible portions 80 and at least one said slot 100 after injection molding. The second flexible portion 90 is assembled to the slot 100 via another process. For example, the second flexible portion 90 can be stuck to the slot 100 via glue or by fritting.

It is noted that the circumferential wall 40 can be formed integrally in one process, and the circumferential wall 40 includes a plurality of said second flexible portions 90. For example, the circumferential wall 40 can be formed through dual injection molding. Practically, a plurality of said first flexible portions 80 are formed via plastic injection molding on an injection molding machine and then a plurality of said second flexible portions 90 are formed via rubber injection molding on the same injection molding machine so that the first and second flexible portions 80, 90 are fritted to each other and formed in only one process.

The circumferential wall 40 further includes a buckle flange 110 surrounding the receiving opening 60. The buckle flange 110 is for fixing with a circumferential flange 142 of the end of the sprayer can 140. Moreover, the buckle flange 110 is a protrusion circumferentially formed inwardly. Preferably, the buckle flange 110 can be formed with a chamfer on an edge, and it is convenient and easy for assembling. The at least one second flexible portion 90 extendedly crosses beyond the buckle flange 110 transversely.

Figure 5:
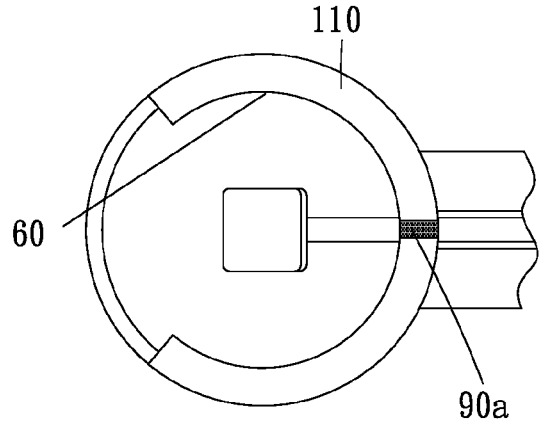
FIG. 5 is a partial perspective drawing of the clamping device in accordance with another embodiment of the present invention.
Figure 6:
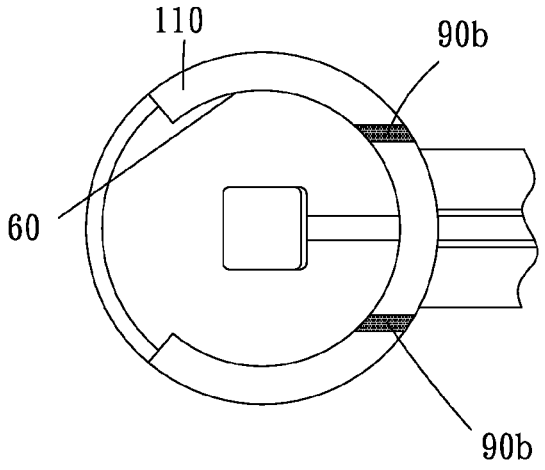
FIG. 6 is a partial perspective drawing of the clamping device in accordance with another embodiment of the present invention.
Figure 7:
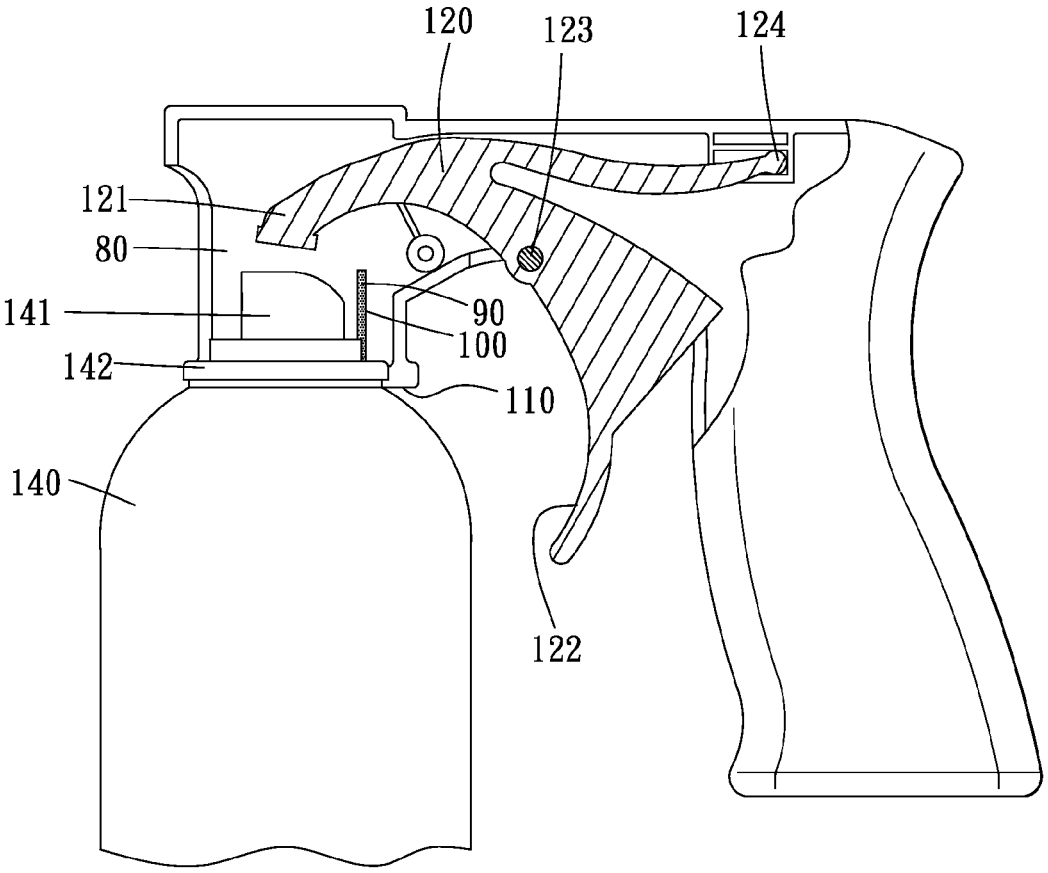
FIGS. 7, 8 are perspective drawings of the clamping device in accordance with an embodiment of the present invention in use.
Figure 8:
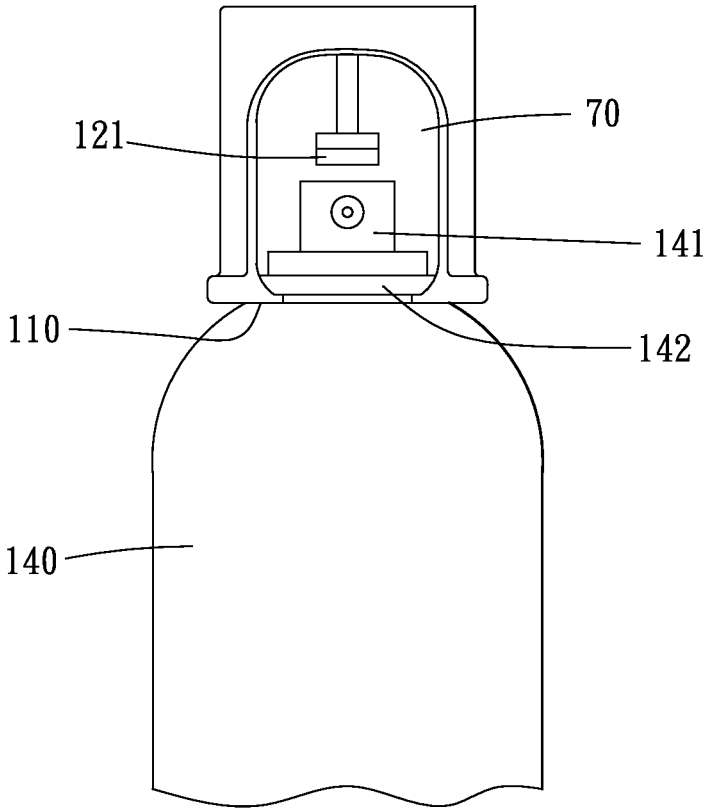

In the present embodiment, the receiving opening 60 is C-shaped. A number of the at least one second flexible portions 90 is two, and the at least one second flexible portion 90 is disposed opposite to an opening of the receiving opening. The second flexible portions 90 are respectively located on different positions so that the receiving opening 60 is divided equidistantly. Preferably, when the clamping portion 30 and the sprayer can 140 are assembled to each other, a clamping force induced between the buckle flange 110 and the circumferential flange 142 of the sprayer can 140 is applied to the circumferential wall 40 averagely, and it is convenient and easy for assembling. Referring to FIG. 5, in other embodiments, a number of the at least one second flexible portion 90*a* is one, and it is located on a position so that the receiving opening 60 is divided equidistantly. Furthermore, in FIG. 6, a number of the at least one second flexible portion 90*b* is two, and the second flexible portions 90*b* are parallel to each other.

The shell body 10 is pivoted with an operating member 120. The operating member 120 includes a first end 121 and a second end 122 which are reversely movable simultaneously. The first end 121 corresponds to the dispenser valve 141 when the clamping portion 30 is used to clamp the end of the sprayer can 140, and when the second end 122 of the operating member 120 is actuated, the first end 121 actuates the dispenser valve 141 to spray. For example, the operating member 120 can be formed with a through hole 123 correspond to the shell body 10. The shell body 10 is disposed with an axle bolt 13 for the through hole 123 of the operating member 120 to sleeve thereto. The operating member 120 is rotatable about the axle bolt 13. Preferably, the second end 122 is located adjacent to the grip portion 20, and the second end 122 is conveniently actuated by hand. It is noted that the operating member 120 further includes an assisting portion 124. The assisting portion 124 is assembled to and stuck with the shell body 10. When the second end 122 is actuated, the assisting portion 124 provides a restituting force for the operating member 120 to move back to a predetermined position.

As a conclusion, the clamping device for the sprayer can is for assembling with the sprayer can to use and prevents a user from contacting with the sprayer can directly. The clamping portion can fix to the circumferential flange of the sprayer can steadily, and the circumferential wall of the clamping portion is designed to conveniently and easily assemble substantially and to have a strong structural strength.

While we have shown and described various embodiments in accordance with the present invention, it should be clear to those skilled in the art that further embodiments may be made without departing from the scope of the present invention.

What is claimed is:

1. A clamping device for a sprayer can, comprising:

a shell body, including a grip portion and a clamping portion for clamping an end of the sprayer can, the sprayer can provided with a dispenser valve at the end, the clamping portion including a circumferential wall, the circumferential wall defining a space for receiving the dispenser valve and a receiving opening communicating with the space, the circumferential wall further formed with a window communicating with the space and for the dispenser valve to spray to outside, the circumferential wall defining a plurality of first flexible portions and at least one second flexible portion transverse to a direction of the receiving opening and extending to the receiving opening, every two adjacent first flexible portions connected with at least one said second flexible portion disposed therebetween, the second flexible portion greater than the first flexible portions in flexibility;

wherein the first flexible portions and the at least one second flexible portion are made of different materials, and the material of the at least one second flexible portion is greater than the material of the first flexible portions in restitution;

wherein the circumferential wall includes a main body formed with the first flexible portions, every two adjacent first flexible portions form a slot therebetween, the slot is transverse to and communicated with the receiving opening, and the at least one second flexible portion is disposed in said slot and connected to the first flexible portions.

2. The clamping device for a sprayer can as claimed in claim 1, wherein the circumferential wall is formed integrally.

3. The clamping device for a sprayer can as claimed in claim 1, wherein the receiving opening is C-shaped, and the at least one second flexible portion is disposed opposite to an opening of the receiving opening.

4. The clamping device for a sprayer can as claimed in claim 1, wherein the shell body includes two shell members, and the two shell members are correspondingly connected to each other.

5. The clamping device for a sprayer can as claimed in claim 1, wherein an operating member pivots in the shell body, the operating member includes a first end and a second end which are reversely movable simultaneously, the first end of the operating member corresponds to the dispenser valve when the clamping portion is used to clamp the end of the sprayer can, and when the second end of the operating member is actuated, the first end actuates the dispenser valve to spray.

6. A clamping device for a sprayer can, comprising:

a shell body, including a grip portion and a clamping portion for clamping an end of the sprayer can, the sprayer can provided with a dispenser valve at the end, the clamping portion including a circumferential wall, the circumferential wall defining a space for receiving the dispenser valve and a receiving opening communicating with the space, the circumferential wall further formed with a window communicating with the space and for the dispenser valve to spray to outside, the circumferential wall defining a plurality of first flexible portions and at least one second flexible portion transverse to a direction of the receiving opening and extending to the receiving opening, every two adjacent first flexible portions connected with at least one said second flexible portion disposed therebetween, the second flexible portion greater than the first flexible portions in flexibility;

wherein the first flexible portions and the at least one second flexible portion are made of different materials, and the material of the at least one second flexible portion is greater than the material of the first flexible portions in restitution;

wherein the circumferential wall further includes a buckle flange surrounding the receiving opening, the buckle flange is for fixing with a circumferential flange of the end of the sprayer can, and the at least one second flexible portion extendedly crosses beyond the buckle flange transversely.

7. A clamping device for a sprayer can, comprising:

a shell body, including a grip portion and a clamping portion for clamping an end of the sprayer can, the sprayer can provided with a dispenser valve at the end, the clamping portion including a circumferential wall, the circumferential wall defining a space for receiving the dispenser valve and a receiving opening communicating with the space, the circumferential wall further formed with a window communicating with the space and for the dispenser valve to spray to outside, the circumferential wall defining a plurality of first flexible portions and at least one second flexible portion transverse to a direction of the receiving opening and extending to the receiving opening, every two adjacent first flexible portions connected with at least one said second flexible portion disposed therebetween, the second flexible portion greater than the first flexible portions in flexibility;

wherein the first flexible portions and the at least one second flexible portion are made of different materials, and the material of the at least one second flexible portion is greater than the material of the first flexible portions in restitution;

wherein the circumferential wall includes a plurality of said second flexible portions.

8. The clamping device for a sprayer can as claimed in claim 7, wherein the second flexible portions are respectively located on different positions so that the receiving opening is divided equidistantly.

* * * * *